United States Patent [19]

Muller

[11] 4,077,154

[45] Mar. 7, 1978

[54] TOY BUILDING BLOCK SET

[76] Inventor: Hermann Müller, Zugerstrasse 43, Cham, Switzerland

[21] Appl. No.: 720,644

[22] Filed: Sep. 7, 1976

[30] Foreign Application Priority Data

Sep. 10, 1975 Austria ..... 6984/75

[51] Int. Cl.[2] ..... A63H 33/06

[52] U.S. Cl. ..... 46/26

[58] Field of Search ..... 46/16, 23–26

[56] References Cited

U.S. PATENT DOCUMENTS 3,451,681 6/1969 Rossetti ..... 46/16

*Primary Examiner*—Louis G. Mancene

*Assistant Examiner*—Robert F. Cutting

*Attorney, Agent, or Firm*—McGlew and Tuttle

[57] ABSTRACT

A toy building block construction comprises at least one building block element which includes three quadrangular discs of substantially equal size disposed to intersect each other in median planes and forming a cube which has longitudinally, transversely and horizontally crossing discs. Each top, bottom and side and end of each cube presents a cross-shaped end face. At least one connecting disc comprising a single quadrangular disc body having respective opposite sides provided with four spaced apart projections on each respective opposite side which bounds a cross-shaped recess sized to receive and interengage with the cross-shaped face of the building block element.

4 Claims, 7 Drawing Figures

FIG. 4
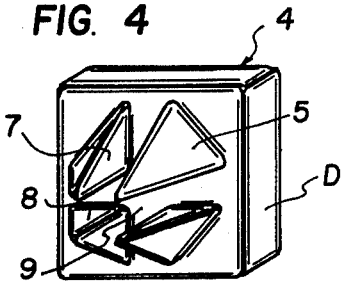
FIG. 5
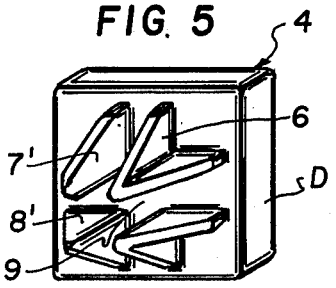
FIG. 6
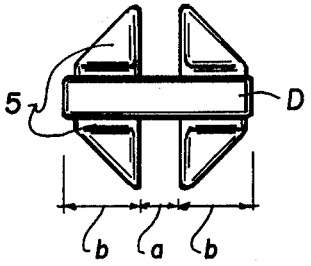
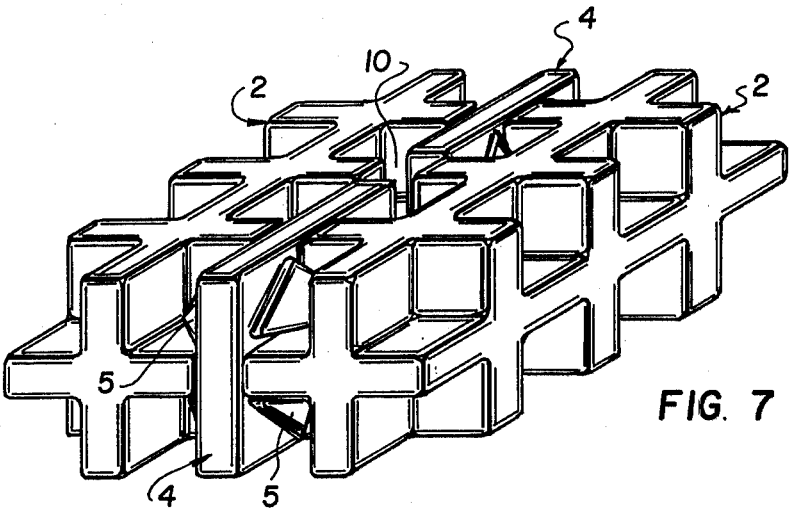
FIG. 7

TOY BUILDING BLOCK SET

BACKGROUND OF THE INVENTION

1. Field of the Invention

This invention relates in general to the construction of toy building blocks and in particular to a new and useful building block set which includes three quadrangular plates of substantially equal size which are disposed to intersect each other in median planes and which may be joined to a separate connecting plate which includes a single disc body having a plurality of projections on each respective side face to form cross-shaped recesses engageable with the cross-shaped ends of the building block element.

2. Description of the Prior Art

Toy building sets are known which contain basic elements which comprise a basic form comprising three quadrangular plates which extend through one another perpendicularly. The further elements of such building sets are rods which can be pegged into the cube shaped element to imitate plane or three-dimensional structures.

SUMMARY OF THE INVENTION

In accordance with the invention the building block set is characterized by elements whose forms are derived from a grating which is formed by lining up the basic form in at least one direction with the interposition of a plate connecting member which extends normal to this direction and which includes means forming interengageable ends of the connecting element for connecting the elements into a desired assembly. The connecting piece is advantageously provided with projections on each of two opposite faces which are arranged to define a cross-shaped receiving recess which receives the cross-shaped end face of a respective connecting element. The single connecting piece therefore serves to interconnect two basic elements and these elements may be connected so as to extend in a single plane or at crossing planes.

Accordingly it is an object of the invention to provide a toy building block construction which comprises at least one building block element which includes three quadrangular discs of substantially equal size disposed to intersect each other in median planes and to form a block having longitudinally, transversely and horizontally crossing discs at each top, bottom, side and end of each block presenting cross-shaped faces and which includes at least one connecting disc comprising a single quadrangular disc body having respective opposite sides with four spaced apart projections thereon defining therebetween the cross-shaped recess sized to receive and interengage with the cross-shaped faces of the building block element.

A further object of the invention is to provide a toy building block construction which is simple in design, rugged in construction and economical to manufacture.

The various features of novelty which characterize the invention are pointed out with particularity in the claims annexed to and forming a part of this disclosure. For a better understanding if the invention, its operating advantages and specific objects attained by its uses, reference should be had to the accompanying drawing and descriptive matter in which there are illustrated preferred embodiments of the invention.

BRIEF DESCRIPTION OF THE DRAWINGS

In the Drawings

FIG. 4 is a perspective view of a connecting piece for the building blocks;

FIG. 5 is a view similar to FIG. 4 of another embodiment of a connecting piece;

FIG. 6 is a top plan view of the connecting piece shown in FIG. 4; and

FIG. 7 is a a plate-shaped assembly of building blocks using the connecting pieces shown in FIG. 4.

GENERAL DESCRIPTION OF THE PREFERRED EMBODIMENTS

Figure 1:
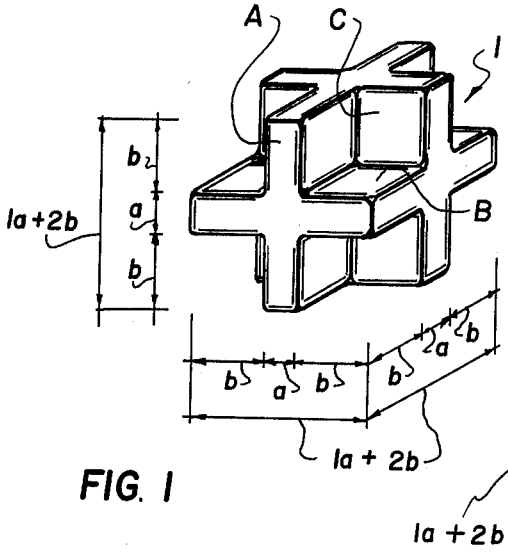
FIG. 1 is a perspective view of a basic building block element constructed in accordance with the invention.

Referring to the drawings in particular, the invention embodied therein comprises a basic element generally designated 1 which cooperates with a connecting element generally designated 4 of a type shown in either FIGS. 4 or 5.

The basic element 1 comprises a cube or block having cross-shaped end faces at all sides and it is made up of an arrangement of three separate quadratic discs A, B and C which extend perpendicular to each other and intersect each other in median planes. As can be seen from FIG. 1 each disc has a thickness $a$ and a projection on each side of the thickness by an amount $b$ so that its side length is equal to $a + 2b$. The ratio of $a$ to $b$ may be any ratio but certain ratios are preferable.

Figure 2:
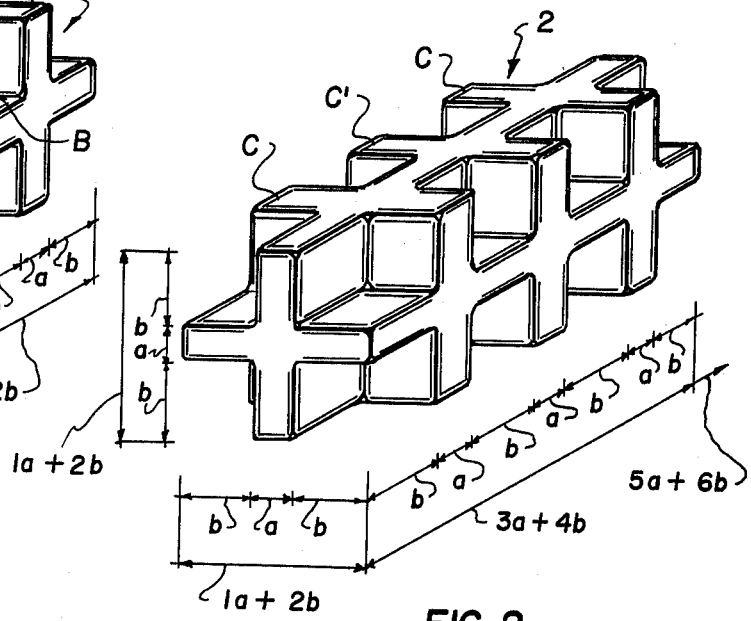
FIG. 2 is a view of an assembly of two building blocks with the interposition of a connecting element therebetween arranged in a longitudinal or rod-shaped continuation.

From this basic form additional elements can be derived. They result in lining up the basic form in one, in two, or in all three directions, but with insertion each time of a connecting disc extending normal to the respective direction, as is apparent from FIG. 2. There is to be noted there a rod 2 whose transverse dimensions correspond to those of the cube 1, while the longitudinal dimension is obtained by lining up two basic forms or respectively two cubes 1 with interposition of a connecting disc C′ to form the integral, single rod 2. The lengthwise dimension therefore is $2 \times (1a + 2b) + a$, or $3a + 4b$. The interposition of connecting disc C′ is essential, for without it the grating pattern, which consists of the continual alternation of the quantities $b$ and $a$, would be disturbed and would no longer correspond to the crosswise dimensions. Rod 2 is merely an example. As is ndicated in FIG. 2, the rod length could be increased as desired by adding further basic forms and interposing additional connecting discs C′. In general, therefore, the length may be expressed by the formula $$L = n \times a + (n + 1) \times b.$$

Figure 3:
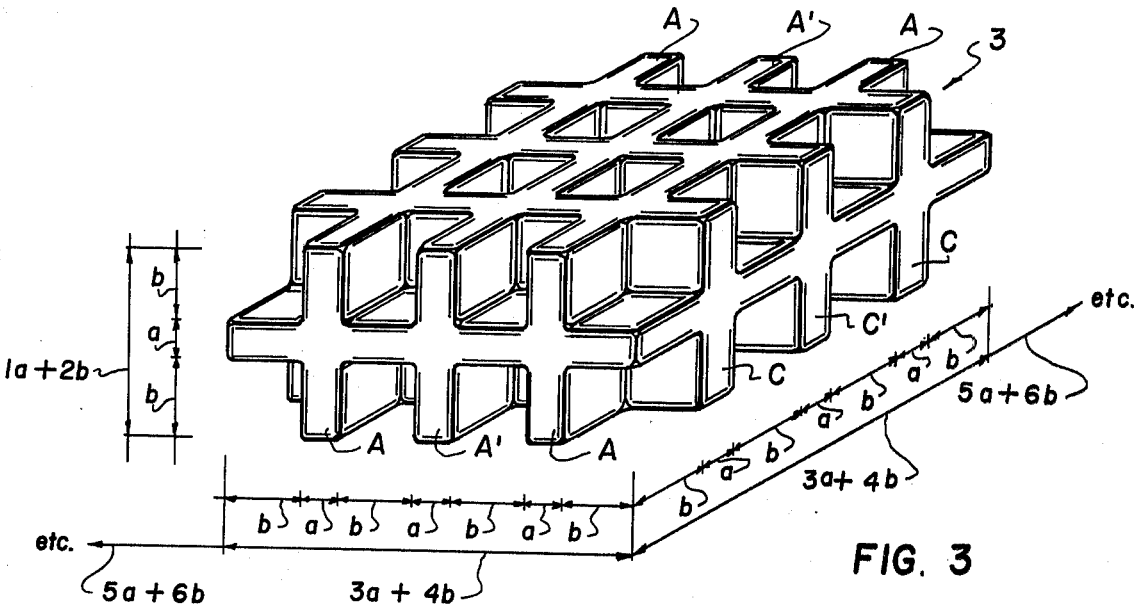
FIG. 3 is a perspective view of an assembly of building block elements and connecting pieces arranged in a plate-shaped configuration.

Analogously the basic form can be extended also in transverse direction to the previously mentioned longitudinal direction, again with insertion of an intermediate disc A′; with simultaneous extension in both directions one obtains the plate 3 according to FIG. 3. It is shown as a square integral plate 3 as an example; but it is of course possible also to make it quadrangular generally. Thus, to operate with the numerical data in FIG. 3, it could have a length of $7a + 8b$ and a width of $3a + 4b$.

By extending the basic form also in the third direction, blocks, or in the specific case, at equal dimensions, cubes are formed. The cubes are not illustrated as they are easy to imagine on the basis of the above statements. They, too, have dimensions of the formula $n \times a + (n + 1) \times b$, $n$ being able to have a different value for each direction. In this third direction, intermediate discs D must then be provided when lining up the basic form, similarly as before.

In consistent development of this principle, therefore, also iregular elements, e.g. angular, stair-shaped or other elements can be developed.

To be able to connect the individual elements together, connecting pieces 4 according to FIG. 4 to 6 are provided. Each connecting piece 4 has a disc D, whose dimension and thickness correspond exactly to the discs A to C of the basic form or to the intermediate discs A', B', and C'. On both sides of this disc D (FIG. 6) projections 5 (FIG. 4) or 6 (FIG. 5) stand out. The projections 5 are pyramid-shaped, the projections 6 are designed as angle pieces. At each projection 5, to sides 7, 8 (which for the sake of clarity are indicated in the figures at different projections) extend at right angles to each other, and all of these sides 7, 8 of all four projections 5 form together a cross-slotted opening 9. The width of this opening, as can be seen from FIG. 6, corresponds to the dimension *a*.

Now each connecting piece 4 can be plugged onto any basic form of one of the elements 1, 2 or 3, and this from any side, as this basic form appears to all sides as a cross which exactly fits into the cross-slotted opening 9. It follows that the height of the projections 5, 6 must not be greater than the dimension *b*. Thus a connecting piece 4 can be plugged on at the element 2 at the top or bottom in the center, laterally in the center or frontally at one of the two ends, at the element at any point of the top or bottom side of the element, at which it can be plugged onto an upwardly or downwardly extending cross of a basic form.

The connecting piece 4 is slipped on until its disc D comes to lie against the respective disks, standing normal thereto, of the respective basic form of element 1, 2 or 3. Then another element can be plugged onto the rear projection. What is essential is the fact that the disc D extends the grating, which is formed by the continual alternation of the quantities *b* and *a* at an element, beyond the junction and combined it with the grating of the connected element to form an uninterrupted total grating.

An example of this is illustrated in FIG. 7. It shows a plate which corresponds in its outer dimensions to plate 3 of FIG. 3. But it consists of two rods 2 which are parallel to each other and are interconnected by two connecting pieces 4. As can be seen, the view of this composite plate is the same as that of plate 3, namely owing to the discs D of the two connecting pieces 4. A channel 10 forms only in the center, because the two connecting pieces 4 and the two rods 2 do not abut. The channel 10 presents a quadratic cross-section having the side length *a*. This channel 10, however, is barely evident, especially when the grating dimension is kept very small, i.e. when *a* and *b* are a few millimeters. At such dimensions, also the depressions of the individual elements resulting from the cross form are not conspicuous any more, and especially large plates 3 appear as approximately smooth elements. The large number of repeating basic forms and the resulting possibility of providing a large number of connecting pieces 4 insures a good stability of the constructions.

While specific embodiments of the invention have been shown and described in detail to illustrate the application of the principles of the invention, it will be understood that the invention may be embodied otherwise without departing from such principles.

What is claimed is:

1. A toy building set, comprising a basic form comprising three quadrangular plates arranged in separate longitudinal, transverse and horizontal planes and extending through one another perpendicularly, characterized by elements whose forms are derived from a grating which is formed by lining up this basic form in at least one direction with interposition of a plate extending normal to this direction, and by connecting pieces for the selective connection of some or all elements with one another, which each consist of a quadrangular plate of the same size and thickness as one of the plates of the basic form, and of projections standing out on both sides of this plate which form on each side of the plate a cross-slotted opening which when pegging the connecting piece onto the basic element or an element or when pegging one of these onto the connecting piece serves to receive two plates of the basic form, while the plate of the connecting piece parallel to the third plate of the basic form places itself against the first-named two plates to form the interpositioned plate between the basic form of one element or of the basic element and the basic form adjacent thereto of the element or basic element now connected with it, and thereby not to interrupt said grating of the two connected parts at their junction.

2. A toy building block construction comprising at least one building block element comprising three quadrangular discs of substantially equal size disposed to intersect each other and median planes and to form a block having longitudinally, transversely and horizontally crossing discs, each top, bottom, side and end of each block having cross-shaped faces, at least one connecting disc comprising a single quadrangular disc body having respective opposite sides, and four spaced apart projections on each of the respective opposite sides defining a cross-shaped recess therebetween sized to receive and interengage with said cross-shaped faces of said building block element.

3. A toy building block element according to claim 2, wherein said projections each comprise angular members disposed at right angles to each other and bevelled inwardly from an outer end.

4. A toy building block according to claim 2, wherein each of said projections define members of pyramidal shape.

* * * * *